US005490594A

United States Patent [19]

Rupe

[11] Patent Number: 5,490,594

[45] Date of Patent: Feb. 13, 1996

[54] GOLF BAG COVER

[76] Inventor: James O. Rupe, P.O. Box 562, West Liberty, Ky. 41472

[21] Appl. No.: 372,926

[22] Filed: Jan. 17, 1995

[51] Int. Cl.[6] ..... A63B 55/00; A63B 57/00

[52] U.S. Cl. ..... 206/315.4; 150/159

[58] Field of Search ..... 150/159, 160; 206/315.2–315.8

[56] References Cited

U.S. PATENT DOCUMENTS

| | | | |
|---|---|---|---|
| 2,010,961 | 8/1935 | Reach | 206/315.6 |
| 2,144,791 | 1/1939 | Burton | 206/315.4 |
| 2,704,563 | 3/1955 | Henrich | 150/159 |
| 3,521,689 | 7/1970 | Woods, Jr. | 150/159 X |
| 3,620,276 | 11/1971 | Taylor | 150/159 |
| 4,234,025 | 11/1980 | Berge | 150/160 X |
| 4,498,579 | 2/1985 | Brick | 150/159 X |
| 4,512,465 | 4/1985 | Jobe | 206/315.4 |
| 4,752,004 | 6/1988 | Very | 150/159 |
| 5,005,623 | 4/1991 | Webster, Jr. | 150/159 |
| 5,058,642 | 10/1991 | Tuntland | 150/159 |
| 5,099,897 | 3/1992 | Curtin | 150/159 |
| 5,131,442 | 7/1992 | Bevier | 150/159 |
| 5,146,967 | 9/1992 | Chapman | 150/159 |
| 5,209,280 | 5/1993 | Gevas | 150/159 |
| 5,220,950 | 6/1993 | Cordasco | 150/159 |

FOREIGN PATENT DOCUMENTS

| | | | |
|---|---|---|---|
| 462572 | 3/1937 | United Kingdom | 206/315.3 |
| 730347 | 7/1957 | United Kingdom | 206/315.3 |
| 1230580 | 5/1971 | United Kingdom | 206/315.3 |
| 2103938 | 3/1983 | United Kingdom . | |

*Primary Examiner*—Sue A. Weaver
*Attorney, Agent, or Firm*—Richard C. Litman

[57] ABSTRACT

A golf bag cover is for use with a golf bag. The cover has a centrally located flap to provide access to an opening in the cover which allows clubs to be removed from the golf bag without removing the cover. The flap and cover have cooperating patches of hook and loop fasteners to seal the flap when the central cavity of the cover is not being accessed. Separate patches of cooperating hook and loop fasteners are provided to secure the cover in a stored condition when not in use. Two sets of patches are located along the outer walls of the cover for use when the cover is folded into a flattened state, and for use when the cover is rolled up for storage. A drawstring at the bottom of the cover secures the cover to bag. A loop which is also provided at the bottom of the cover mates with the bag to prevent accidental removal of the cover.

14 Claims, 3 Drawing Sheets

GOLF BAG COVER

BACKGROUND OF THE INVENTION

1. Field of the Invention

The present invention relates to an improved golf bag cover which is stored easily, and deploys to protect golf clubs from the rain and elements.

2. Description of the Prior Art

An 18 hole round of golf can be played in under three hours on an uncrowded course. A round of golf played during the weekend can be extended to over five hours on crowded golf courses in large metropolitan areas. Because of the length of a typical round of golf and the unpredictability of the weather, an average golfer can find himself far away from the club house trapped in a rainstorm ranging from a light sprinkle to a heavy downpour. While many golfers are frustrated by nature's onslaught and head for the club house, others pursue completion of their round in spite of the rain. With the increasing popularity of golf necessitating in many areas of the country that a round of golf be scheduled many weeks in advance to secure a weekend time slot, golfers are often unwilling to let the rain interfere with their one chance to play, knowing that it could be at least a week before another chance to play arises.

Whether the golfer decides to play on or to head back for the club house to sit out the rain, the player's utmost concern is to protect his clubs from the elements. The typical golf bag sold on the market is a long cylindrical tube with an open upper end to receive the golf clubs. The bag is designed to provided maximum access to the clubs and only performs marginally to protect the clubs from rain and other precipitation. In response to this shortcoming, covers have been developed to attach to the top of the bag or to completely enclose the bag to better protect the clubs.

U.S. Pat. No. 4,234,025 issued to Berge on Nov. 18, 1980, shows one such golf bag club cover. The cover has a drawstring at the base for securing the cover around the golf bag. A flap at the top of the cover, and extending the entire length of the cover, allows access to the clubs while the cover is on. FIG. 3 shows the cover flattened or folded for storage when the cover is not in use.

U.S. Pat. No. 5,005,623 issued to Webster, Jr. on Apr. 9, 1991, shows a variation of a golf bag rain cover wherein a wide access panel extends from the top of the bag. A loose, oversized flap prevents rain or water from entering the golf bag cover. A cut out slot accepts the ring of the golf bag to aid in securing the cover to the bag. Hook and loop type fasteners are provided to maintain the flap when the clubs are not being accessed.

U.S. Pat. No. 5,131,442 issued to Bevier on Jul. 21, 1992, shows another variation golf bag cover for protecting golf clubs. The cover has a wide flap midway down one wall of the cover. On the outside of the flap a plastic enclosure is provided to retain a score card away from the rain. Cut away sections of the golf bag near the bottom of the cover provide an opening for mating with the ring of the golf bag. A drawstring is also provided near the bottom of the cover to maintain the bottom of the cover in close contact with the golf bag.

U.S. Pat. No. 5,209,280 issued to Gevas on May 11, 1993, shows a hard shell type, protective hood for a golf club bag. As an alternate to the loose, generic fitting hood, Gevas discloses a hard shell mated to fit with a particular bag. The hard shell provides for protection against impact, but is less practical to carry on the golf course.

U.S. Pat. No. 5,220,950 issued to Cordasco on Jun. 22, 1993, shows a golf bag cover for covering an entire golf bag. The top portion of the cover is generally cylindrical and includes a zippered opening to allow access to the clubs.

British Patent 2,103,938 published on Mar. 2, 1983, shows a canopy type golf bag cover which attaches to the handle of a golf pull cart. A hook at the top of the cover attaches to another point on the handle to secure the cover across the top of the clubs, to reduce the amount of rain striking the clubs.

Because a large proportion of the golfers carry their own clubs and equipment, it is important that a golf bag cover can be conveniently packed into a small volume for storage in the golf bag, and can be readily deployed to protect the bag and clubs from the elements. The use of a flap on the cover is also desirable for the player who continues to play in the rain so that the clubs can be accessed with out the tedious process of removing the cover from the bag and without exposing a large volume of the mouth of the bag to the elements. None of the above inventions and patents, taken either singly or in combination, is seen to describe the instant invention as claimed.

SUMMARY OF THE INVENTION

The present invention provides an improved cover for a golf bag which mates securely with the golf bag when employed, and folds or is rolled up into a compact form when not in use. Hook and loop fasteners such as patches of VELCRO™ are placed around the walls of the cover, such that the patches engage each other when the cover is rolled up or folded flat, to maintain the cover in a convenient, stored condition. The cover may then be easily stored in the golf bag for quick deployment during a sudden rain shower.

A central flap may be provided on one face of the cover to allow access to the golf clubs without removing the cover. Hook and loop fasteners are provided to seal the flap against the hood to prevent water from entering the golf bag when the clubs are not being accessed.

A drawstring is provided at the bottom of the cover, along with a plurality of snaps, and a metallic ring, to secure the cover onto a wide variety and range of styles of golf bags. The snaps are arranged at standard spacing to engage golf bags which are provided with mating cover snaps. The drawstring may be used on golf bags which are not manufactured with snaps, to maintain the cover in close contact with the outer wall of the golf bag, minimizing the possibility of water entering the golf bag.

Accordingly, it is a principal object of the invention to provide a new and novel golf bag cover which can be selectively installed onto a golf bag to protect the golf clubs in the bag from the rain and elements.

It is another object of the invention to a golf bag cover which fits securely onto a wide range of golf bags.

It is a further object of the invention to provide a golf bag cover which can be folded up or rolled up and secured in the compact state for easy and convenient storage.

Still another object of the invention is to provide a golf bag which has a sealable flap which provides quick access to the golf clubs contained in the bag without necessitating removal of the cover.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to an improved golf bag cover which is easily stored and is quickly deployable to protect golf clubs from the rain and elements. Referring now to figures, the invention will be described in greater detail.

Figure 1:
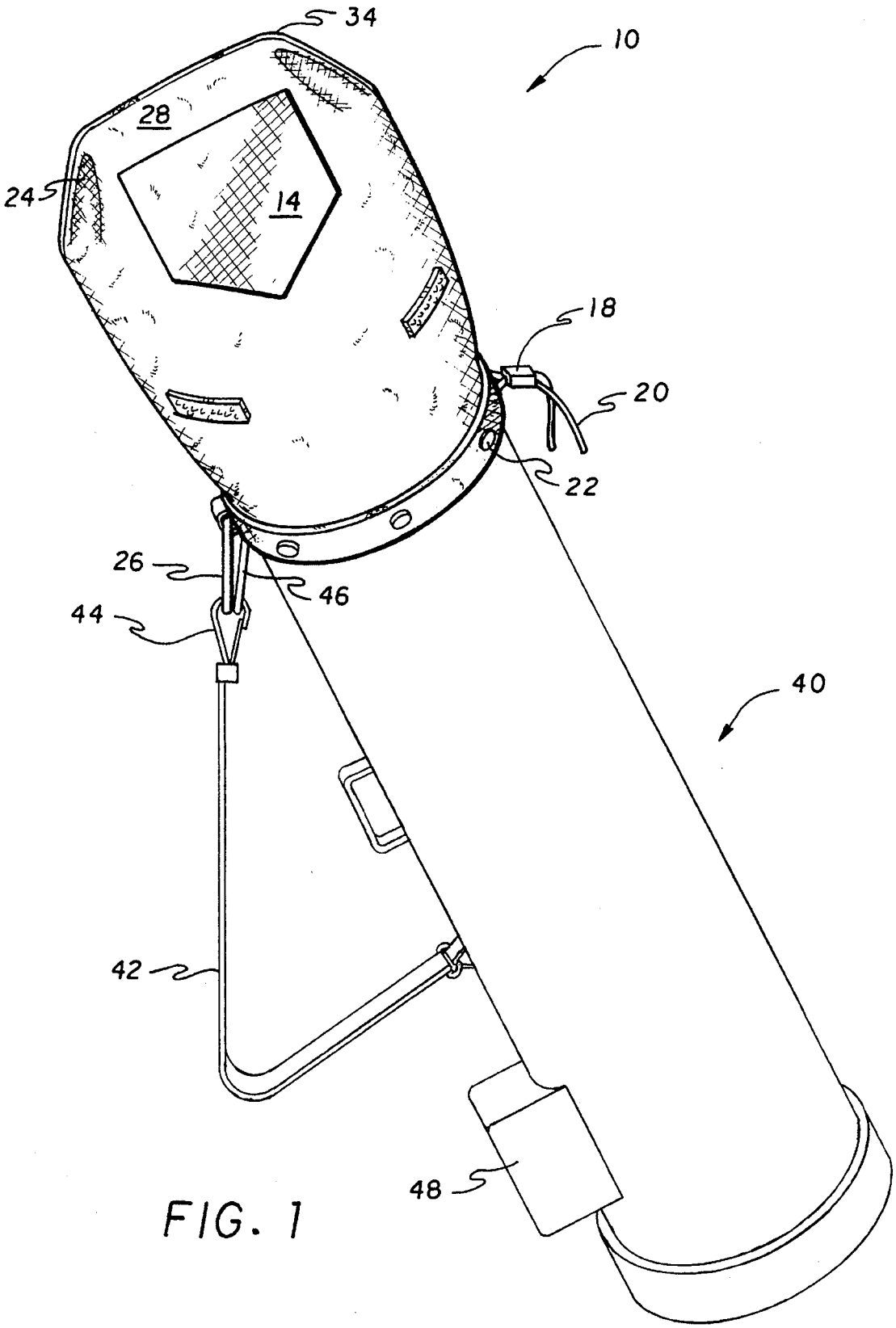
FIG. 1 is an environmental perspective of golf bag cover according to a first embodiment of the invention shown attached on a golf bag.

FIG. 1 shows a golf bag cover 10 according a first embodiment of the present invention attached to a golf bag 40. The golf bag shown is a well-known, generic golf bag having a handle 42 attached to a ring 46 by a hook 44.

Figure 2:
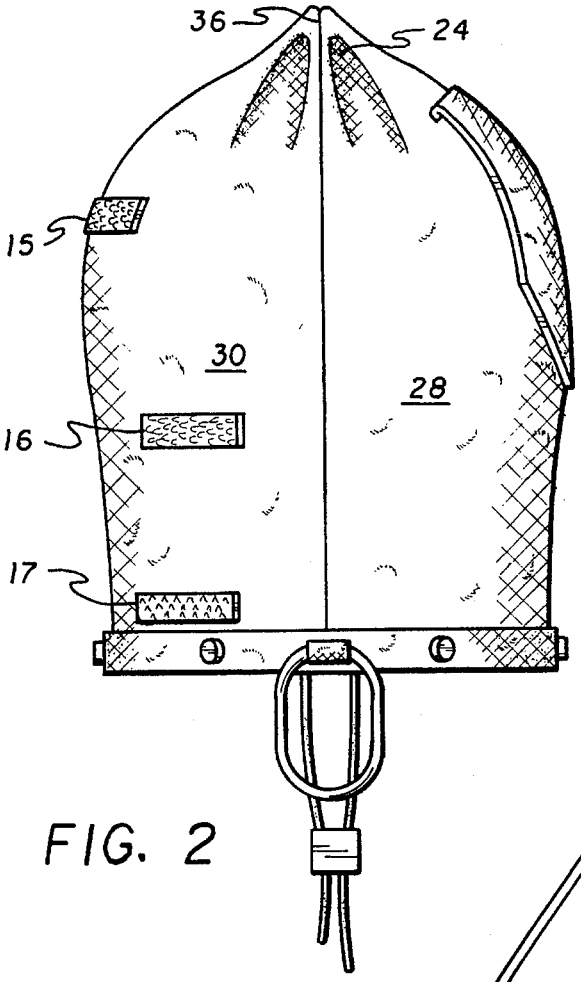
FIG. 2 is a side elevation view of a golf bag cover according to a first embodiment of the invention.

The cover 10 is made of two panels of material forming a front wall 28 and a rear wall 30 (see FIG. 2). The two panels are sewn together along their top and side edges along seam 36, as best seen in FIG. 2, to define a sheath having an inner cavity with an opening along the bottom edge of the cover to receive the top portion of the golf bag. Pleats 24 can be provided at the top of the cover 34 (FIG. 1) to relieve material stress when the top panels of the cover are stitched together.

The bottom edge of the golf bag cover has snaps 22 and a draw string 20 to securely mate the cover to the golf bag. The snaps are used to mate with golf bags manufactured with snaps, and the drawstring 20 is used to mate with bags do not have existing snaps. The drawstring is provided with a lock 18 to maintain the drawstring 20 at a fixed length and to secure the bottom edge of the cover 10 against the golf bag 40.

The cover is further secured to the bag by an anchor ring 26 which overlaps the ring 46 of the golf bag. The two rings 26,36 are locked together by the hook 44 of the golf bag strap to prevent removal of the cover 10 from the bag.

A flap 14 is provided on the face of the cover to allow the user to access the internal cavity of the cover 10. The opening covered by flap provides the user with the ability to remove individual golf clubs from the golf bag without having to remove the cover itself. The top-hinged flap is positioned on the cover such that the tallest club, usually the driver, can easily be removed from the bag. Cooperating releasable fasteners such as "hook and loop" type fasteners (not shown) are provided around the periphery (sides and bottom) of the opening and on the edges of the flap to secure the flap against the cover when the clubs are not being accessed.

Figure 3:
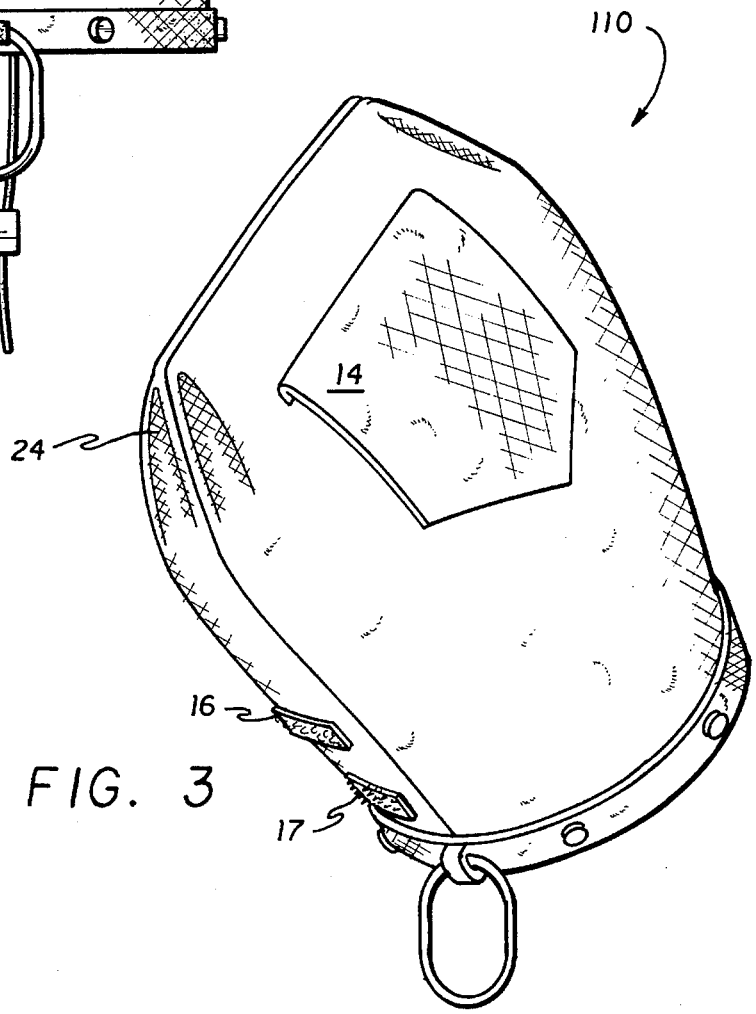
FIG. 3 is a perspective view of the front and side of a golf bag cover according to a second embodiment of the present invention.

In an alternate embodiment as shown in FIG. 3, the cover 110 can also be manufactured without an access flap. In this second embodiment of the cover, all of the functions of the cover of the first embodiment are present except for the flap. The cover provides an enhanced sealing ability against the weather and has a lower cost associated with its production due to its simplified manufacturing requirements.

Figure 5:
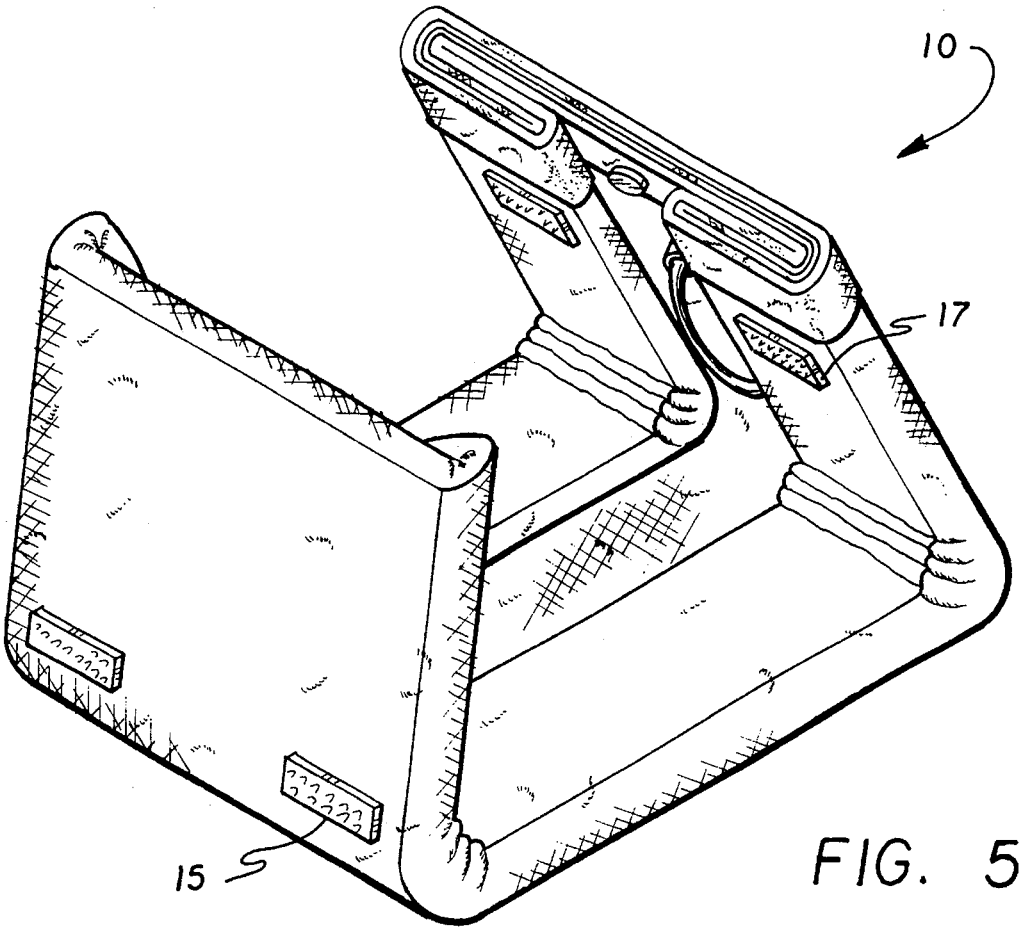
FIG. 5 is a perspective view showing the locations of the hook and loop fasteners which secure the twice-folded golf bag cover in a stored condition.
Figure 4:
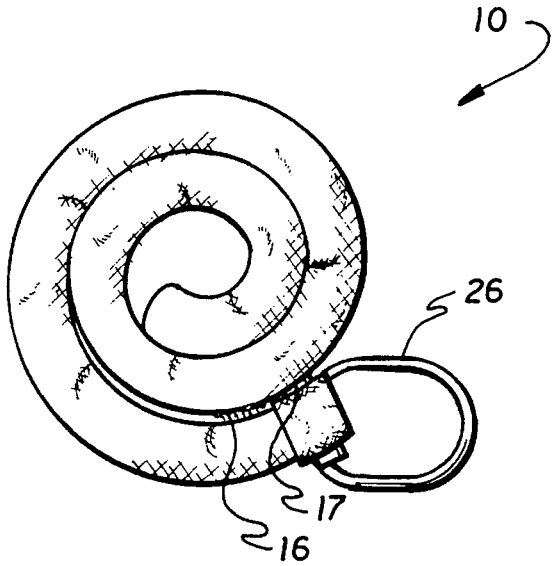
FIG. 4 is a side elevation showing the engaging hook and loop fasteners of the golf bag cover rolled up into an alternate stored condition.

As shown in FIGS. 4 and 5, a golf bag cover according to either embodiment is shown with patches 15,16,17 of hook and loop fasteners being provided at predetermined locations along the rear or wall 30, respectively, of the cover. When the cover 10 is not in use, the cover can be folded as shown in FIG. 5 to flatten the cover for storage. The cooperating patches 15,17 mate to maintain the cover in a folded condition. The ring 26 is folded neatly inside the cover 10 and out of the way. With the cover occupying the reduced volume stored condition, as shown, the cover can be easily and conveniently stored in a pocket 48 of the golf bag (FIG. 1) for ready deployment during a rain storm.

To facilitate an alternate method of storage, the golf bag cover 10 in FIG. 4 is also provided with a second set of patches 16 covered with hook and loop type fasteners which mate with patches 17 when the cover is folded at the sides as in FIG. 5 and then rolled up for storage as shown in FIG. 4. The patches 15,16,17 are prepositioned on the rear panel to allow the cover 10 to be rolled up and secured in the stored position with the patches 16, 17 mating to maintain the shape of the cover.

One skilled in the art would recognize that modifications could be made to the cover to mate the cover with various fasteners according to the design of the golf bag. The cover could also be made to match the color, style, or logo of the golf bag as needed. The location of the hook and loop fastener patches could also be relocated to allow the cover to be folded along different fold lines, or folded into a different shape.

Accordingly, it is to be understood that the present invention is not limited to the sole embodiment described above, but encompasses any and all embodiments within the scope of the following claims.

I claim:

1. A flexible and foldable golf bag cover for covering a golf bag comprising:

a flexible sheath having a front wall, a rear wall, means joining said front wall and said rear wall to define a top portion and a bottom portion;

said flexible sheath further having a first closed end at the top portion and a second open end at the bottom portion;

said bottom portion of said rear wall including two releasable first cooperating fasteners;

said top portion of said rear wall including at least two releasable second cooperating fasteners which cooperate with said two releasable first fasteners in said bottom portion; and said flexible sheath is folded to a flattened configuration by engaging said two releasable first cooperating fasteners on said bottom portion with said two releasable second cooperating fasteners on said top portion; whereby said folded flexible sheath can be stored in an available pocket of a golf bag.

2. A golf bag cover according to claim 1, wherein said releasable first and second cooperating fasteners are hook and loop fasteners.

3. A golf bag cover according to claim 1, wherein said bottom portion of said rear wall includes at least a third releasable cooperating fastener; and said flattened flexible sheath is further rolled up to a storing configuration to engage said releasable first fasteners with the third releasable cooperating fasteners.

4. A golf bag cover according to claim 1, wherein said front wall includes means defining an opening for accessing the clubs carried by a golf bag, and a flap hinged at its top portion for covering said opening.

5. A golf bag cover according to claim 4, wherein said flap further includes a first releasable cooperating fastener and said front wall includes a second releasable cooperating fastener for selectively engaging said flaps releasable fastener.

6. A golf bag cover in combination with a golf bag for carrying golf clubs comprising:

a flexible sheath having a front wall, a rear wall, and means joining said front wall to said rear wall to define a top portion and a bottom portion;

said flexible sheath further having a first closed end at the top portion and a second open end at the bottom portion;

said bottom portion of said rear wall including at least two releasable first cooperating fasteners;

said top portion of said rear wall including at least two second releasable cooperating fastener which cooperate with said releasable first fasteners in said bottom portion;

said flexible sheath is folded to a flattened configuration by engaging said two releasable first cooperating fasteners on said bottom portion with said two releasable second cooperating fasteners on said top portion; and storing said folded sheath in a side pocket of said golf bag.

7. A golf bag and cover according to claim 6, wherein said releasable first and second cooperating fasteners are hook and loop fasteners.

8. A golf bag and cover according to claim 6, wherein said bottom portion of said rear wall includes at least a third pair of releasable cooperating fasteners; and said flattened flexible sheath is further rolled up to a storing configuration to engage said third pair of releasable cooperating fasteners with said two first releasable cooperating fasteners on said bottom portion.

9. A golf bag and cover according to claim 6, wherein said front wall includes means defining an opening for accessing the clubs carried in said golf bag and a flap for covering said opening.

10. A golf bag and cover according to claim 9, wherein said flap further includes a first releasable cooperating fastener and said front wall includes a second releasable cooperating fastener for selectively engaging said flaps releasable fastener.

11. A golf bag and cover according to claim 6, wherein said bottom portion of said flexible sheath includes means defining a pocket extending circumferentially around said bottom portion, there further being a drawstring carried within said pocket for securing said flexible sheath around an open end of said golf bag.

12. A golf bag and cover according to claim 11, wherein said flexible sheath includes a plurality of snaps on said bottom portion of said flexible sheath for mating with available snaps on an open end of said golf bag.

13. A golf bag and cover according to claim 12, wherein the open end of said golf bag includes a hook and said flexible sheath further includes a ring for engaging with said hook of said golf bag.

14. A golf bag and cover according to claim 6, wherein an open end of said golf bag includes a hook and said flexible sheath further includes a ring for engaging with said hook of said golf bag.

* * * * *